US007789718B2

(12) United States Patent
Desard et al.

(10) Patent No.: US 7,789,718 B2
(45) Date of Patent: Sep. 7, 2010

(54) CONNECTOR ARTICLE FOR A CABLE, HOLDER FOR A CONNECTOR OF SUCH A CONNECTION ARTICLE, AND KIT FOR CONNECTING CABLES

(75) Inventors: Christophe Desard, Cergy Pontoise Cedex (FR); Didier Touillon, Cergy Pontoise Cedex (FR); Yvonnick Marsac, Cergy Pontoise Cedex (FR)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/518,589

(22) PCT Filed: Nov. 30, 2007

(86) PCT No.: PCT/US2007/085995

§ 371 (c)(1),
(2), (4) Date: Jun. 10, 2009

(87) PCT Pub. No.: WO2008/079588

PCT Pub. Date: Jul. 3, 2008

(65) Prior Publication Data

US 2010/0022119 A1 Jan. 28, 2010

(30) Foreign Application Priority Data

Dec. 20, 2006 (EP) ..... 06126733

(51) Int. Cl.
*H01R 11/09* (2006.01)

(52) U.S. Cl. ..... 439/796; 439/797; 439/798; 439/654; 439/276; 439/936; 439/521

(58) Field of Classification Search ..... 439/276, 439/936, 521, 654, 750, 784, 796–798
See application file for complete search history.

(56) References Cited

U.S. PATENT DOCUMENTS 3,879,575 A * 4/1975 Dobbin et al. ..... 174/92

(Continued)

FOREIGN PATENT DOCUMENTS

DE 3202747 8/1983

(Continued)

*Primary Examiner*—Tho D Ta
(74) *Attorney, Agent, or Firm*—Melanie G. Gover

(57) ABSTRACT

A connection article is provided for a cable comprising at least one wire. The connection article comprises a holder, at least one connector arranged in the holder and having a first receiving opening for receiving a wire to be connected, and guiding means arranged in front of the first receiving opening of the at least one connector, the first receiving opening defining a cross section and the guiding means comprising at least one guiding passage extending through the guiding means and aligned with the first receiving opening of the at least one connector for guiding a wire into the first receiving opening of the connector. The at least one guiding passage comprises opposite distal and proximal ends, the proximal end facing towards and the distal end facing away from the first receiving opening of the at least one connector. The proximal end has a cross section not larger than the cross section of the first receiving opening of the at least one connector. The distal end has a cross section larger than the cross section of the proximal end.

15 Claims, 5 Drawing Sheets

U.S. PATENT DOCUMENTS

| | | | | |
|---|---|---|---|---|
| 4,458,976 | A * | 7/1984 | Hudson et al. | 439/797 |
| 4,902,252 | A * | 2/1990 | Whorton et al. | 439/796 |
| 5,033,982 | A | 7/1991 | Lucas | |
| 5,106,319 | A * | 4/1992 | Julian | 439/224 |
| 5,383,022 | A | 1/1995 | Kaeser | |
| 5,683,273 | A * | 11/1997 | Garver et al. | 439/784 |
| 5,885,104 | A | 3/1999 | Foster et al. | |
| 6,071,145 | A * | 6/2000 | Toly | 439/485 |
| 6,099,345 | A | 8/2000 | Milner et al. | |
| 6,231,216 | B1 | 5/2001 | Frasch | |
| 6,296,240 | B1 | 10/2001 | Nakai et al. | |
| 6,364,721 | B2 * | 4/2002 | Stewart, III | 439/784 |
| 6,814,630 | B1 * | 11/2004 | Tomasino | 439/784 |
| 6,855,888 | B2 | 2/2005 | Jacke | |
| 2002/0039858 | A1 * | 4/2002 | Kamel et al. | 439/521 |
| 2005/0271328 | A1 | 12/2005 | Ohtsu et al. | |

FOREIGN PATENT DOCUMENTS

| | | |
|---|---|---|
| EP | 80372936 | 6/1988 |
| EP | 0924713 | 6/1999 |
| EP | 0963873 | 12/1999 |
| EP | 81180823 | 2/2002 |
| JP | 08149679 | 6/1991 |

* cited by examiner

CONNECTOR ARTICLE FOR A CABLE, HOLDER FOR A CONNECTOR OF SUCH A CONNECTION ARTICLE, AND KIT FOR CONNECTING CABLES

CROSS REFERENCE TO RELATED APPLICATIONS

This application is a national stage filing under 35 U.S.C. 371 of PCT/US2007/085995, filed Nov. 30, 2007, which claims priority to European Patent Application No. 06126733.2 filed Dec. 20, 2006, the disclosure of which is incorporated by reference in its/their entirety herein.

BACKGROUND

1. Field of the Invention

The present invention provides a connection article for a cable comprising at least one wire. Moreover, the present invention also relates to holder for at least one connector for a cable. Finally, the present invention also relates to a kit for connecting cables.

2. Description of the Prior Art

In a plurality of diverse applications it is necessary to connect electrical cables comprising at least one wire. One exemplary application for cables to be connected is the power line for traffic lights, street lamps for illuminating streets or public places or other electric loads for which cables having relatively rigid wires are used, In particular, cables comprising wires having larger cross sections are difficult to insert into the connectors arranged in a holder for holding a plurality of connectors. The stiffness of the individual wires makes it difficult to properly insert all the wires simultaneously in the individual receiving openings of the connectors Another requirement of connection assemblies is that the individual connectors are arranged in a holder while being kept electrically insulated from each other. Typically, a connection article comprises a protective shell for receiving the holder which in turn comprises the individual connectors. After termination of the individual wires at the connectors, the holder is inserted into the protective shell and an encapsulant material for filling out the space within the protective shell around the holder is introduced into the protective shell. It is important that the encapsulant material keeps the individual wires and connectors spaced apart from each other by a minimum distance between adjacent cables and adjacent connectors.

Wire spacers for connection assemblies are known e.g. from EP-8-0 372 936 and U.S. Pat. No. 6,099,345. These wire spacers are designed as elements for keeping individual cables or wires separated from each other. The use of the known wire spacers for electrical connectors is rather complicated because the individual connectors have to be arranged around the wire spacers, which is time consuming and requires some training and experience.

Guiding means for aligning mating connector elements of a connection article are basically known. These known connection assemblies require two connector elements for each cable to be connected wherein the connector elements are guided relatively to each other. One example of such a connection article is disclosed in US-A-2005/0271328. The known systems require the termination of the wires to be connected at the mating connector elements which again results in the problem mentioned above if the wires are rather rigid due to the size of their cross sections.

From EP-8-1 180 823 a cable connection article is known in which individual pins of one mating connector element penetrate between the individual parallel conductor fibers of the wires of a cable fixedly arranged in the other mating connector element. In such a connector there is the risk that the electrical connection between the pins and the conductor fibers of the individual cables is not reliable.

In order to facilitate the insertion of wires in the receiving openings of electrical connectors it is known to provide the connection article with insertion guiding means. An example of such a connection article is disclosed in EP-B-0 763 873. The known insertion guiding means comprises a guiding passage having a conical shape and being tapered towards the connector receiving opening. However, in the known connection article it is still necessary that the individual wires are inserted into the connectors in a direction more or less parallel to the longitudinal extension of the connectors. Namely, otherwise it is still possible (and to be expected in particular for stiff wires) that the individual wires could contact an edge around the receiving openings of the individual connectors.

From DE-A-32 02 747 a plug is known comprising insertion funnel passages for connecting the wires of a cable to contact pins of the plug.

Another requirement for a multi-wire cable connection article is easy access to the fastening means (such as screws or the like) of the individual connectors. In particular, when the connectors are arranged for providing a compact connection article requiring only little space, an easy access to the fastening elements is still necessary.

Accordingly, there is a need for improved connection article fulfilling the above-mentioned requirements in an easy manner and which is easy to handle.

SUMMARY

The present invention provides a connection article for a cable comprising at least one wire, wherein the connection article comprises a holder, at least one connector arranged in the holder and having a first receiving opening for receiving a wire to be connected, and guiding means arranged in front of the first receiving opening of the at least one connector, the first receiving opening defining a cross section and the guiding means comprising at least one guiding passage extending through the guiding means and aligned with the first receiving opening of the at least one connector for guiding a wire into the first receiving opening of the connector, wherein the at least one guiding passage comprises opposite distal and proximal ends, the proximal end facing towards and the distal end facing away from the first receiving opening of the at least one connector, wherein the proximal end has a cross section not larger than the cross section of the first receiving opening of the at least one connector, wherein the distal end has a cross section larger than the cross section of the proximal end, wherein the distal end has a cross section larger than the cross section of the proximal end, wherein the at least one connector comprises a second receiving opening arranged opposite the first receiving opening and provided for receiving another wire, wherein another guiding means comprising a passage aligned with the second receiving opening is arranged in front of the second receiving opening, and wherein two guiding means are arranged at opposite ends of the receiving space.

In another aspect of the present invention there is provided a holder for at least one connector for a cable comprising at least one wire, wherein the holder includes a body having at least one receiving space for receiving at least one connector having a first receiving opening for receiving a wire to be connected, and guiding means arranged in front of the body and comprising at least one guiding passage extending through the guiding means and aligned with the receiving space for guiding a wire inserted into the guiding passage towards the receiving space, wherein the at least one guiding passage comprises opposite distal and proximal ends, the proximal end facing towards and the distal end facing away from the receiving space, wherein the proximal end has a cross section not larger than a cross section of the first receiving opening of the at least one connector to be located in the receiving space, and wherein the distal end has a cross section larger than the cross section of the proximal end.

The connection article according to the present invention comprises a holder having at least one receiving space for receiving a connector for a wire. The connector has at least one (first) receiving opening for receiving the wire to be connected. Typically, such a connector comprises two receiving openings at e.g., opposite ends of the connector. Such a connector typically has a tubular shape and comprises fastening members like e.g. fastening screws extending into the inner hollow space of the connector to engage the wires to be connected by clamping the wires to the connector.

In front of the receiving space and the first receiving opening of the connector arranged in the receiving space of the holder there is arranged a guiding means for guiding a wire into the first receiving opening of the connector. The guiding means comprises at least one guiding passage extending through the guiding means and aligned with the first receiving opening of the at least one connector. The guiding passage comprises two opposite ends, namely a distal and a proximal end wherein the proximal end faces towards the first receiving opening of the at least one connector (e.g. the receiving space of the holder) and the distal end faces away from the connector and, accordingly, receives the wire to be guided towards and into the connector. For this purpose the distal end of the guiding passage has a cross section which is larger than the cross section at the proximal end of the guiding passage. According to the invention, the proximal end of the guiding means has a cross section which is not larger than the cross section of the first receiving opening of the at least one connector. This arrangement guarantees that the guiding passage and, in particular, the interface between the guiding passage and the connector is free of any shoulders, edges, or surfaces facing the distal opening of the guiding passage.

The guiding means and the relation between the cross sections at the distal and proximal ends of the guiding passage and the cross section of the receiving opening of the connector establish an insertion aid for the wire to be connected. This insertion aid is very helpful in particular in a multi-wire cable having rather rigid wires which typically are not aligned with the associated connectors but which are automatically exactly aligned with the connectors by means of the guiding passages of the guiding means arranged in front of the holder holding the individual connectors.

For electrically insulating the individual connectors in case of a holder comprising a plurality of connectors, the holder typically is made from an electrically insulating material. In an alternative embodiment, the holder can comprise also other materials and, in particular, electrically conductive materials if the individual connectors are arranged electrically insulated relative to the holder. For example, between the individual connectors and the holder there can be arranged an insulating material while the holder as such is made from an electrically conductive material.

In the present invention, a plurality of connectors can be arranged in a fixed relative arrangement at the holder. Accordingly, the holder also functions as a connector spacer keeping the individual connectors separated and insulated from each other.

According to the invention each connector of the connection article comprises first and second receiving openings which normally are opposite to each other for receiving two wires to be connected. In such an embodiment, according to the invention, typically one guiding means is arranged in front of each of the receiving openings, respectively.

In one embodiment of the present invention, the guiding passage of each guiding means is substantially conically shaped. Normally or generally the guiding passage at its inner wall along 360° of its peripheral extension tapers from the distal end to the proximal end. Also it is preferred that the inner surface of the guiding means substantially is even. As an alternative, the inner surface can comprise grooves or ridges extending longitudinally at the inner surface of the guiding means.

In another embodiment of the present invention, the holder holds a plurality of connectors, i.e. the holder is provided with a plurality of receiving spaces each receiving at least one connector wherein each guiding means comprises a plurality of guiding passages extending therethrough with each guiding passage aligned with a respective one of the first openings of the plurality of connectors. In such a connection article it is preferred to arrange the connectors equidistantly to a longitudinal axis of the holder. Such an arrangement is advantageous in that fastening means of the individual connectors are accessible from the outer side of the holder within a circumferential angle of not more than about 270° and, preferably, not more than about 180°. Namely, arranging the connectors in the holder in such a way is convenient for manipulating the connectors for fastening the cables in that the access to all the fastening means of all the connectors is given within an area around the holder extending over less than 360° so that there is no need to access fastening means e.g. from underneath the holder. Namely, as soon as the cables to be connected are inserted into the connectors, in particular in case of rigid cables it is not possible to turn the holder around so as to engage the fastening means at a lower portion of the outer side of the holder. Since the holder in this configuration i.e. with the wires inserted into the connectors, is difficult to rotate or turn around, it is the more important that none of the fastening means have to be manipulated from underneath the holder.

As mentioned above, typically the connection article is surrounded by a protective shell bridging the area between the outer jackets of two cables. For keeping a space around the holder between the holder and the protective shell it is preferred to provide the holder and/or each guiding means with outer spacer projections. These outer spacer projections allow for centering the connection article within the protective shell so that an encapsulant material (e.g., a two component resin made commercially available by 3M Company, St. Paul, Minn., USA under the trade name SCOTCHCAST) can be inserted into the protective shell for filling out the space between the connection article and the protective shell.

Typically, for safety reasons, power cables are provided with cable shields or screens arranged around the group of wires of the cable and surrounded by an outer insulating layer of the outer jacket of the cable. It is important that the cable shields of the two cables to be connected are also electrically connected. In one embodiment of the present invention, the holder and/or each guiding means comprises or comprise at least one outer clamp for fixing the additional wire for connecting the cable shields.

In another aspect of the present invention there is provided a kit for connecting cables each comprising at least one wire, wherein the kit comprises

- a connection article according to at least one of the above-mentioned embodiments,
- a protective shell for surrounding the connection article, and
- an encapsulant material for filling out a space within the protective shell located around the connection article when arranged within the protective shell.

In an alternative embodiment of the present invention, the kit comprises

- a holder according to at least one of the above-mentioned embodiments,
- at least one connector for arranging within the holder,
- a protective shell for surrounding the holder, and
- an encapsulant material for filling out a spacer within the protective shell located around the holder when arranged within the protective shell.

In both embodiments of the kit an encapsulant material is provided for filling out the space within the protective shell around the connection article. The encapsulant material typically is introduced through a hole in the protective shell. After having filled out the space within the protective shell around the connection article, the hole in the protective shell is closed. The encapsulant material can be curable or non-curable and, in particular, can be a resin or gel or foam (preferably a non-open cell foam for preventing water from penetrating through the foam).

The connection article of the present invention can be provided with a body forming the holder and the guiding means as one part or as separate elements. Accordingly, the holder and guiding means can be formed integral with each other. Typically, the holder and guiding means are made from plastics material in an injection moulding process. In such a process, the connector or the connectors can be inserted in the mould prior to forming the connection article. Typically, the holder and each guiding means are separate elements which are fit together and assembled after forming the individual elements.

BRIEF DESCRIPTION OF THE DRAWINGS

The present invention will be described in more detail referring to the drawings in which.

DESCRIPTION OF A PREFERRED EMBODIMENT

Figure 1:
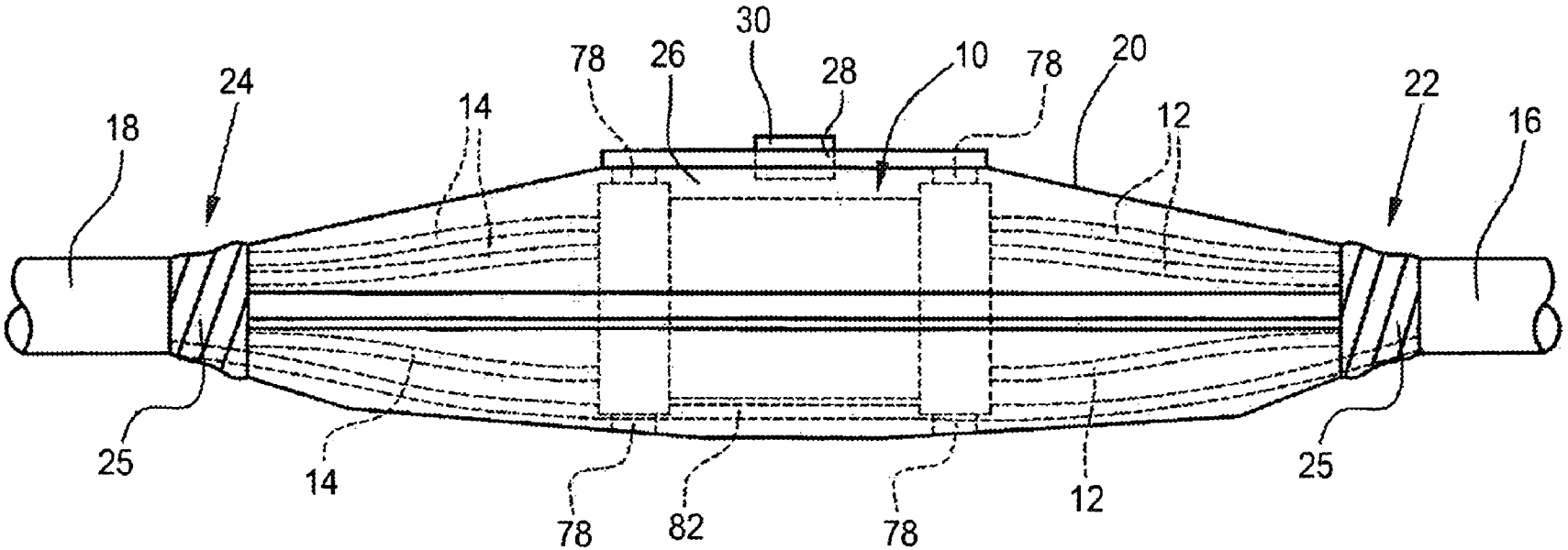
FIG. 1 shows a protective shell for a connection article for connecting the individual wires of two power line cables.

FIG. 1 shows a connection article 10 for connecting the individual wires 12,14 of two power line cables 16,18. The connection article 10 is arranged within an outer protective shell 20 having two opposite ends 22,24 surrounding the cables 16 and 18 and sealed thereto e.g. by a mastic material 25. The space 26 within the protective shell 20 around the connection article 10 as well as around the individual wires 12,14 is filled out with an encapsulant material such as resin. This material is filled into the protective shell 20 via an opening 28 closed by a lid 30.

The design and construction of the connection article 10 is shown in more detail in FIGS. 2 to 5.

Figure 2:
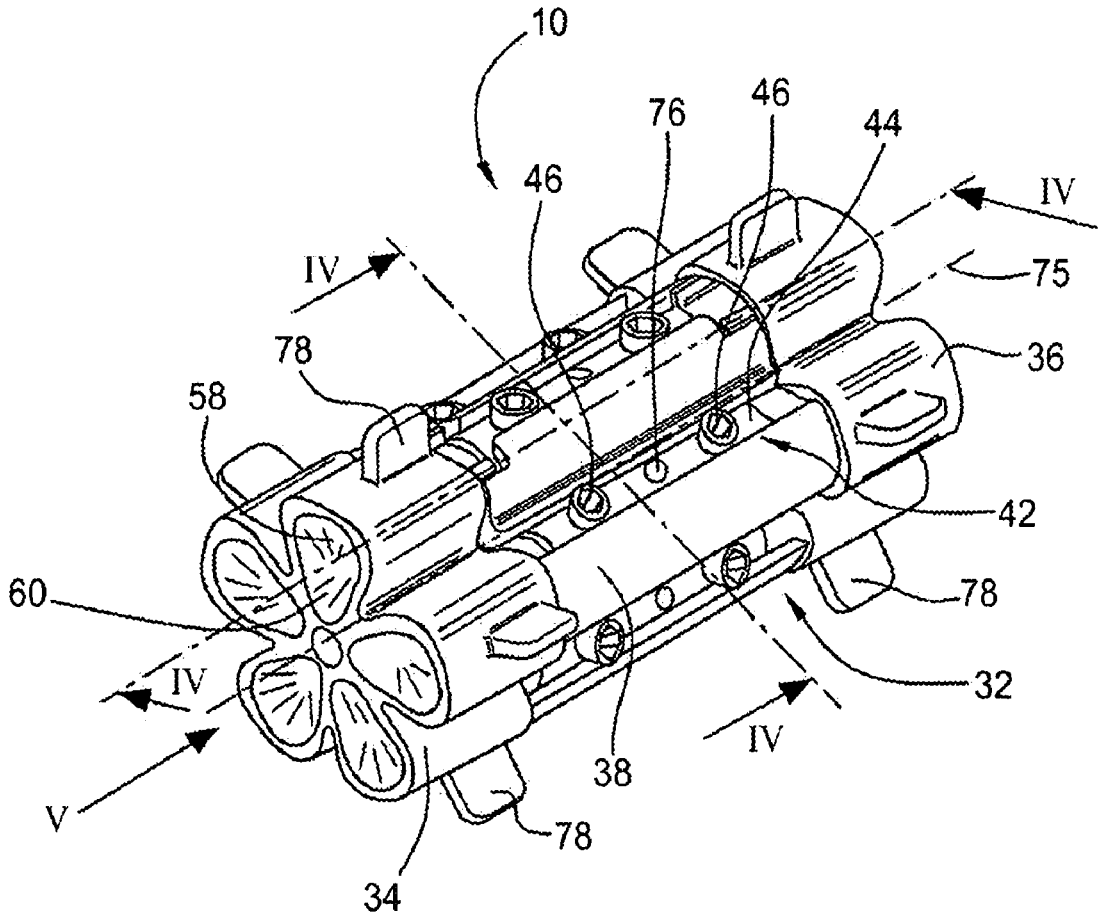
FIG. 2 is a perspective view of the connection article with the individual elements thereof assembled to each other.
Figure 3:
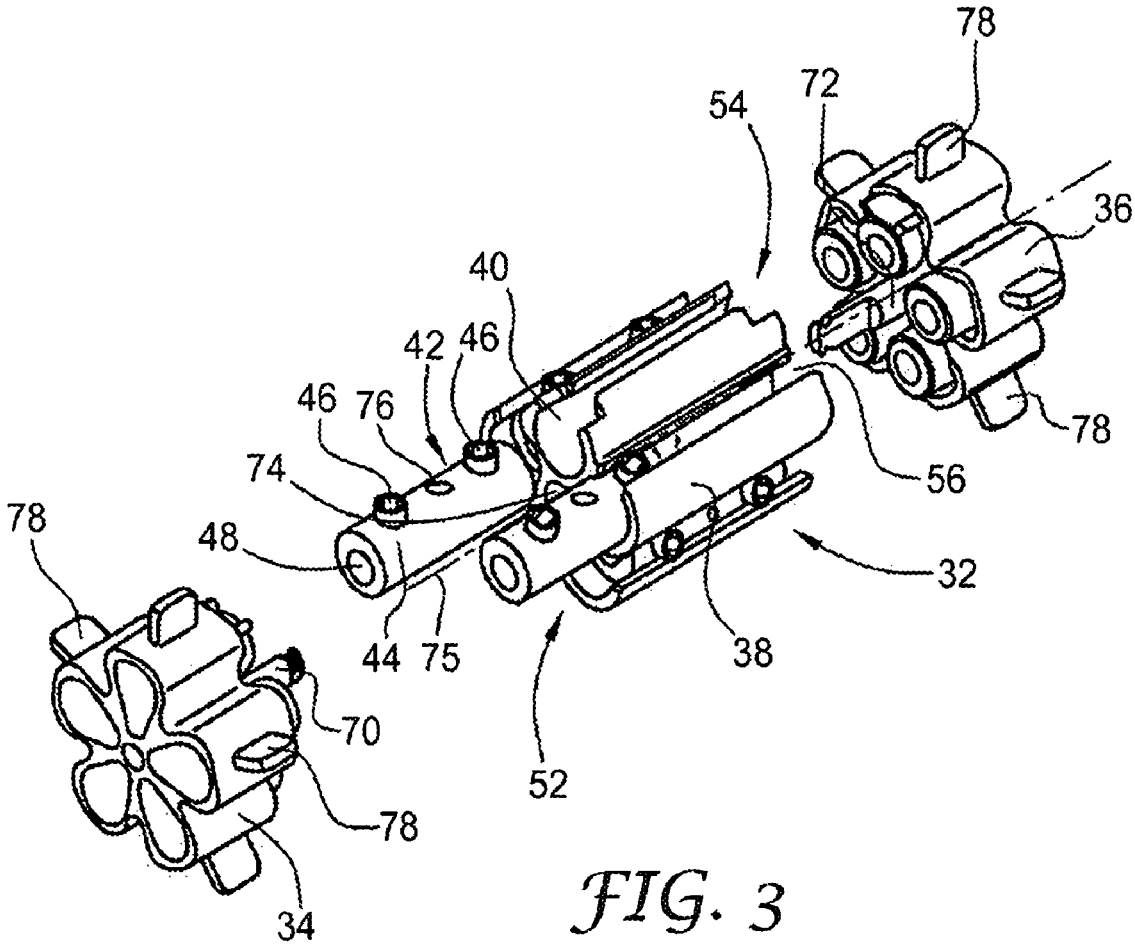
FIG. 3 is a perspective and exploded view of the connection article according to FIG. 2.

The individual elements and parts of the connection article 10 are shown in FIGS. 2 and 3. The connection article 10 comprises a holder 32 and two wire insertion guiding elements 34,36 arranged at opposite sides of the holder 32. The holder 32 includes a body 38 having a longitudinal extension and comprising receiving spaces 40 for receiving substantially tubular electrical connectors 42. In this embodiment, the body 38 of the holder 32 includes five receiving spaces 40 with five connectors 42 arranged therein. Each connector 42 comprises an electrically conductive sleeve 44 with two fastening screws 46 for clamping the electric wires 12,14 inserted into receiving openings 48,50 of the connectors 42 (see also FIG. 5).

In this embodiment the receiving spaces 40 are open towards the opposite ends 52,54 of the body 38 of the holder 32. Accordingly, the connectors 42 can be inserted into the receiving spaces 40 from one of the opposite ends 52,54. Moreover, the receiving spaces 40 are provided with slit-like openings 56 at the circumferential outer side of the body 38. In the assembled state when the connectors 42 are inserted into the receiving spaces 40, the fastening screws 46 extend through the slit-like openings 56 allowing access to the fastening screws 46 and, in particular, preventing the tubular connectors 42 from rotating within the receiving spaces 40 so that the fastening screws 46 maintain their position so as to allow access from the circumferential outer side of the holder 32 which in particular is helpful prior to tightening the screws 46 for connecting the wires.

As shown in FIGS. 2 to 5, each guiding element 34,36 is provided with a plurality of guiding passages 58 identical in number to the receiving spaces 40 and, accordingly, connectors 42 of the body 38 of the holder 32. Each guiding passage 58 is provided with an inlet opening 60 and an outlet opening 62 (see also FIG. 5). The outlet opening 62 is arranged proximal to the receiving opening 48,50, respectively, of the connector 42 while the inlet opening 60 is located distal from the connector 42. Moreover, each guiding passage 58 is provided with a substantially conically shaped or tapered section 64 and a substantially cylindrical section 66. The tapered section 64 comprises the inlet opening 60 which has a cross section larger than that of the outlet opening 62 at which the substantially cylindrical section 66 of the guiding passage 58 is terminated. In this embodiment, the inner surface 68 of each guiding passage 58 is substantially even.

Figure 5:
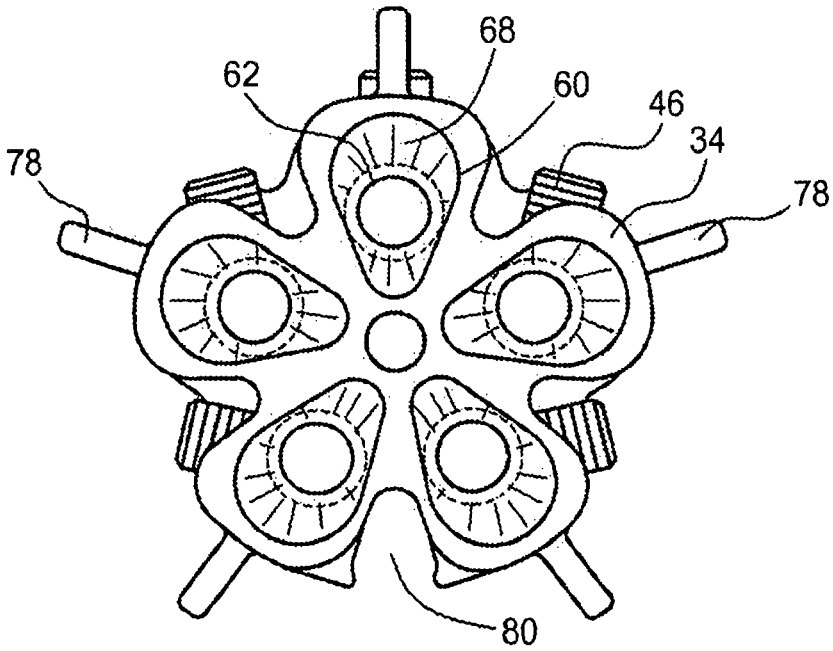
FIG. 5 is an end view of the connection article in direction of V of FIG. 2.
Figure 6:
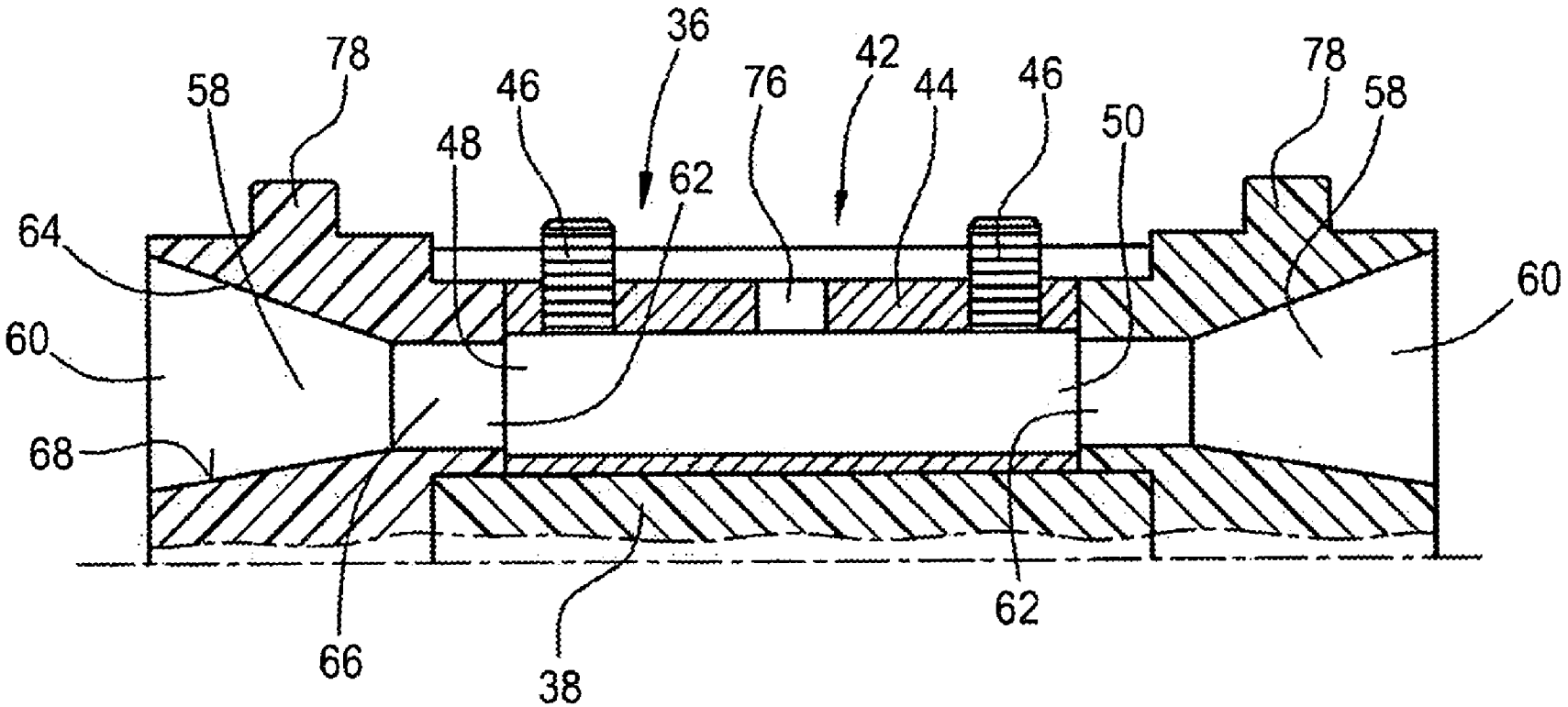
FIG. 6 is a partial cross sectional view through the connection article taken along line VI-VI of FIG. 2.

As shown in particular in FIG. 5, the cross section of the outlet opening 62 of each guiding passage 58 is smaller than the cross section at the receiving opening 48,50 of the connector 42. Generally, the cross section of the outlet opening 62 is not larger than the cross section of the receiving opening 48 or 50 of the connector 42. This design allows the wire 12,14 entering or inserting into the guiding passage 58 through its inlet opening 60 to be smoothly guided into the connector 42 since neither in the guiding passage 58 nor at its interface to the connector 42 there are inwardly protruding portions so that the guiding passage 58 and the receiving openings 48,50 of the connectors 42 are free of any obstacles or stops for the wire 12,14 to be connected.

The guiding elements 34,36 as well as the body 38 of the holder 32 are preferably made from a plastics material. This kind of material allows sufficient bonding to the encapsulant material arranged around the connection article 10 within the protective shell 20 for sealing against humidity so as to prevent any humidity from entering the interface between the holder 32 and the encapsulating material. The plastics material of the body 38 also contributes to the electrical insulation of the individual connectors 42. As can be seen in particular from FIG. 3, the two guiding elements 34,36 are provided with protruding tabs 70,72 inserted at the opposite ends of a receiving channel 74 extending through the body 38 of the holder 32 along its longitudinal direction 75. Within the receiving channel 74 the two tabs 70,72 are snap-fit so as to hold the guiding elements 34,36 in place at the opposite ends 52,54 of the holder 32. Other technical solutions attaching the guiding elements 34, 36 to the holder 32 are possible like e.g. glueing, screwing.

Figure 4:
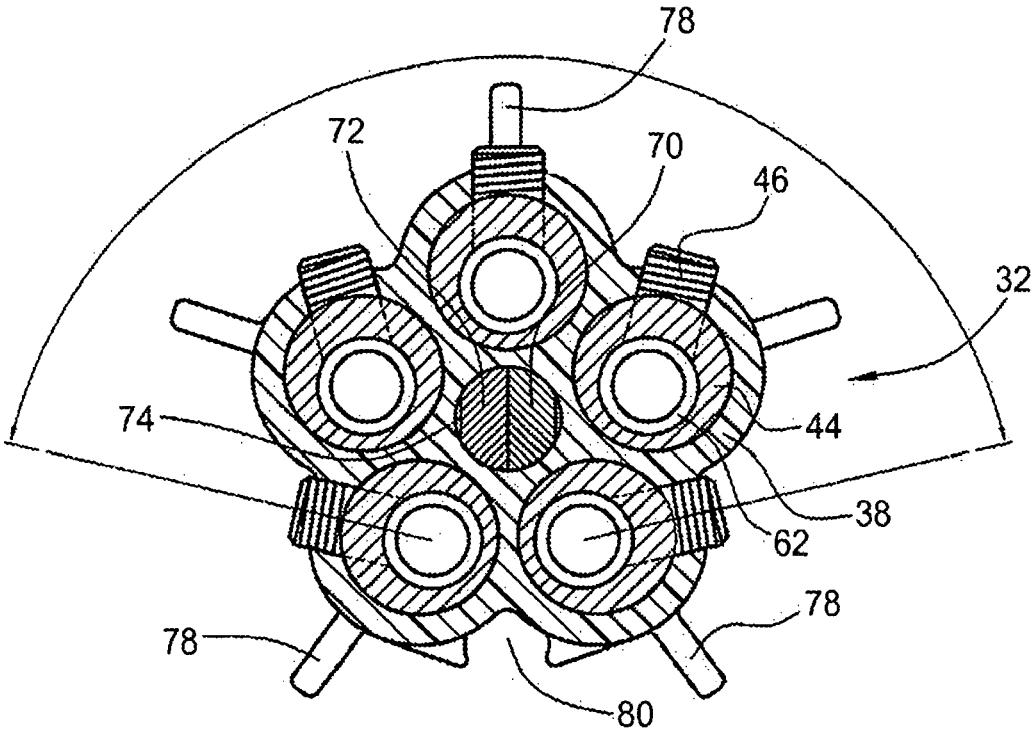
FIG. 4 is a cross sectional view taken along line IV-IV of FIG. 2.

As can be seen in particular from FIG. 4, the screws 46 of all the connectors 42 are accessible from an outer side of the body 38 of the holder 32 within a circumferential angle of less than 180°. This allows the holder 32 to be arranged and to be supported by a support in the position as shown in FIG. 4 in which access to all the screws 46 is given without turning the holder 32 around for accessing the screws 46 of the two lower most connectors 42.

Moreover, as shown in FIGS. 2, 3, and 5, the sleeve 44 of each connector 42 is provided with an observation hole 76 arranged substantially in the middle of the connector 42 for inspecting and observing the wires 12,14 to be connected so as to be inserted properly in the respective connector 42.

As mentioned before, the whole connection article 10 is centered in the protective shell 20 and located spaced apart therefrom by means of several spacer projections 78 arranged around the two guiding elements 34,36. This allows for maintaining sufficient space all the way around the connection article 10 within the protective shell 20 so that this space can be filled out with the encapsulant material.

Also from FIGS. 4 and 5 it can be seen that the connection article 10 further comprises clamping recesses 80 at the outer sides of the guiding elements 34,36 serving for clamping and holding an additional wire 82 for connecting protective metallic screens (not shown) of the cables 16,18.

In the illustrated embodiment of the connection article the guiding elements 34,36 and the holder 42 are shown and described as individual elements assembled to each other for forming the connection article. It is to be noted that all these elements including the connectors can be insert-molded as one unitary piece or part thereof e.g. one of the guiding elements and the body of the holder are formed as one part.

Although the invention has been described and illustrated with reference to the specific illustrative embodiment thereof, it is not intended that the invention be limited to this illustrative embodiment. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A connection article for a cable comprising at least one wire, the connection article comprising a holder configured to hold multiple connectors, at least one tubular connector arranged in the holder and having a first receiving opening at one end of the tube for receiving a wire to be connected, and guiding means having multiple guiding passages to guide at least one wire into each of the multiple connectors arranged in front of the first receiving opening of the at least one connector, the first receiving opening defining a cross section and the guiding means comprising at least one guiding passage extending through the guiding means and aligned with the first receiving opening of the at least one connector for guiding a wire into the first receiving opening of the connector, wherein the at least one guiding passage comprises opposite distal and proximal ends, the proximal end facing towards and the distal end facing away from the first receiving opening of the at least one connector, wherein the proximal end has a cross section not larger than the cross section of the first receiving opening of the at least one connector, wherein the distal end has a cross section larger than the cross section of the proximal end, wherein the at least one connector comprises a second receiving opening arranged at the tube end opposite the first receiving opening and provided for receiving another wire, wherein another guiding means comprising a passage aligned with the second receiving opening is arranged in front of the second receiving opening, and wherein the wires are held in place by tightening screws.

2. The connection article according to claim 1, wherein the guiding passage is tapered from the distal end to the proximal end.

3. The connection article according to claim 1, wherein the guiding passage of each guiding means is substantially conically shaped.

4. The connection article according to claim 1, wherein one or both of the holder and each guiding means comprises outer spacer projections for maintaining a position of the holder and each guiding means in a protective shell spaced apart from the protective shell.

5. A kit for connecting cables each comprising at least one wire, the kit comprising a connection article according to claim 1, a protective shell for surrounding the connection article, and an encapsulant material for filling out a space within the protective shell located around the connection article when arranged within the protective shell.

6. The connection article according to claim 1, wherein a plurality of connectors insulated from each other are arranged in the holder and a plurality of guiding passages extend through each guiding means and wherein each guiding passage is aligned with a respective one of the first receiving openings of the plurality of connectors.

7. The connection article according to claim 6, wherein the connectors are arranged equidistant to a longitudinal axis of the holder.

8. A holder for multiple connectors for a cable comprising multiple wires, the holder comprising a body having multiple receiving spaces for receiving multiple tubular connectors, each connector having a first receiving opening at one end of the tube for receiving a wire to be connected and at least one tightening screw to hold the wire in place, and guiding means configured to guide at least one wire into each of the multiple connectors arranged in front of the body and comprising multiple guiding passages extending through the guiding means and aligned with the receiving spaces for guiding a wire inserted into a guiding passage towards an aligned receiving space, wherein at least one guiding passage comprises opposite distal and proximal ends, the proximal end facing towards and the distal end facing away from the receiving space, wherein the proximal end has a cross section not larger than a cross section of the first receiving opening of the connector to be located in the receiving space, wherein the distal end has a cross section larger than the cross section of the proximal end, wherein guiding means are arranged at each opposite end of the receiving spaces.

9. The holder according to claim 8, wherein the body comprises a plurality of receiving spaces having opening through which the tightening screws extend thereby preventing the connectors from rotating within the receiving spaces.

10. The holder according to claim 8, wherein the guiding passage is tapered from the distal end to the proximal end.

11. The holder according to claim 8, wherein the guiding passage of each guiding means is substantially conically shaped.

12. The holder according to claim 8, wherein the body comprises a plurality of receiving spaces having openings to position the tightening screws of the multiple connectors such that all the screws are accessible within a circumferential angle of less than 180 °.

13. The holder according to claim 8, wherein the receiving spaces are arranged equidistant to a longitudinal axis of the body.

14. The holder according to claim 8, wherein one or both of the body and each guiding means comprises outer spacer projections for maintaining a position of the body and each guiding means in a protective shell spaced apart from the protective shell.

15. A kit for connecting cables each comprising at least one wire, the kit comprising a holder according to claim 8, at least one connector for arranging within the holder, a protective shell for surrounding the holder, and an encapsulant material for filling out a spacer within the protective shell located around the holder when arranged within the protective shell.

* * * * *

UNITED STATES PATENT AND TRADEMARK OFFICE

CERTIFICATE OF CORRECTION

PATENT NO. : 7,789,718 B2
APPLICATION NO. : 12/518589
DATED : September 7, 2010
INVENTOR(S) : Christophe Desard It is certified that error appears in the above-identified patent and that said Letters Patent is hereby corrected as shown below:

Column 1,
Line 34, after "connectors" insert -- . -- therefore

Signed and Sealed this

Thirtieth Day of November, 2010

David J. Kappos

David J. Kappos
*Director of the United States Patent and Trademark Office*